US006374435B1

(12) United States Patent
Leininger et al.

(10) Patent No.: US 6,374,435 B1
(45) Date of Patent: Apr. 23, 2002

(54) PATIENT TRANSFER DEVICE AND RELATED METHODS

(75) Inventors: Peter A. Leininger; John H. Vrzalik, both of San Antonio; Cesar Z. Lina, Universal City, all of TX (US)

(73) Assignee: KCI Licensing, Inc., San Antonio, TX (US)

( * ) Notice: Subject to any disclaimer, the term of this patent is extended or adjusted under 35 U.S.C. 154(b) by 0 days.

(21) Appl. No.: 09/465,050

(22) Filed: Dec. 16, 1999

(51) Int. Cl.[7] ..... A61G 7/14
(52) U.S. Cl. ..... 5/81.1 HS; 5/81.1 C
(58) Field of Search ..... 5/81.1 C, 81.1 HS, 5/81.1 T, 926

(56) References Cited

U.S. PATENT DOCUMENTS

| | | | | |
|---|---|---|---|---|
| 3,947,902 A | | 4/1976 | Conde et al. | |
| 4,051,565 A | * | 10/1977 | Berge | 5/81.1 C |
| 4,073,016 A | | 2/1978 | Koll | |
| 4,077,073 A | | 3/1978 | Koll et al. | |
| 4,528,704 A | | 7/1985 | Wegener et al. | |
| 4,627,426 A | | 12/1986 | Wegener et al. | |
| 4,686,719 A | | 8/1987 | Johnson et al. | |
| 4,944,053 A | * | 7/1990 | Smith | 5/81.1 C |
| 5,005,232 A | * | 4/1991 | Wright et al. | 5/81.1 C |
| 5,067,189 A | | 11/1991 | Weedling et al. | |
| RE35,299 E | | 7/1996 | Weedling et al. | |
| 6,012,183 A | * | 1/2000 | Brooke et al. | 5/81.1 C |

FOREIGN PATENT DOCUMENTS

| | | | | |
|---|---|---|---|---|
| GB | 002159047 A | * | 11/1985 | 5/81.1 HS |

* cited by examiner

*Primary Examiner*—Michael F. Trettel

(57) ABSTRACT

A manually-powered patient conveyor is disclosed in the form of a continuous belt which reduces friction beneath the patient to enable lateral patient transfer from one patient support surface to another. With the belt positioned beneath the patient, a caregiver can readily grip circumferencial handles on the belt to help pull the patient sideways from one surface to another, while borasilicate glass micro-bubbles or other lubricants are dispersed on the interior of the sleeve-like belt to further minimize friction during patient transfer.

17 Claims, 3 Drawing Sheets

PATIENT TRANSFER DEVICE AND RELATED METHODS

FIELD OF THE INVENTION

The present invention relates to methods and apparatus to enable movement of patients, typically from one patient support surface to another. More particularly, the present invention is related to patient transfer devices and related methods, which involve moving the patient laterally (i.e., sideways) from one bed, gurney or the like to another.

BACKGROUND

"Patient transfer" in this field refers to the process of moving a patient from one patient support surface to another. The need for routine patient transfer seems unavoidable in virtually all phases of health care. It is commonly required whenever a patient is moved from an ambulance stretcher to an emergency room gurney, from a gurney to an examining table or operating room table, from one type of therapeutic surface to another, from a bed to a wheelchair, and at many other transitions in between.

The manual patient transfer maneuver, however, is both physically and psychologically demanding. The typical process involves a team of two or more caregivers first lifting and then sliding the patient's body sideways from the first surface to the next. Because the two supports typically have to be positioned side-by-side, at least half the transfer team is in an awkward position at any given point during the transfer, having to help lift the patient while they are bending and reaching over one of the supports. This can be fairly hazardous, particularly if one of the beds starts moving midstream. Large or obese patients are especially challenging, which is compounded by the fact that many caregivers tend to be petite in stature.

Because of such demands, health care workers who have patient transfer duties are at high risk for back injury. It goes without saying that the patients are likewise at risk due to falls or the like when caregivers are inadequate to meet the physical demands of transferring the patient. Although such risks are widely known and are well documented in current literature, the modern economics of commercial health care does not allow the industry to adequately address the issue, and injuries occur at staggering levels.

Patient transfer devices are likewise well known in the medical field and have long been used to help minimize the struggles, frustrations and hazards associated with patient transfer. The principal object of most patient transfer devices is to reduce the effort required in patient transfer and, consequently, reduce the risk of injuries to both patient and caregiver.

The most common device used to aid patient transfer is the draw sheet. Probably since the days of the earliest patient transfers, caregivers have simply gripped the bed linen beneath the patient and used the linen to help drag the patient across the surface of the bed. From that background, commercial draw sheets were then developed to facilitate the process. The principal characteristic of such commercial draw sheets is that they are made of high-strength fabric so as to resist ripping and tearing while in use. Heavy-duty cotton fabrics are typical, although variations have been known for particular applications. In the early 1980's, for instance, Mediscus Products Limited commercialized special draw sheets formed of the same polyurethane-coated, vapor-permeable nylon material as the air cushions of their "low-air-loss" beds. Although generally simple and relatively low-cost, commercial draw sheets still require significant force to drag them from one bed to another.

Several other prior attempts to deal with such problems have utilized inflatable plenums to essentially "float" the patient from one support to another. Such plenums were typically "log-rolled" under the patient, and then inflated so that air would leak out from the plenum in order to reduce friction, letting the patient slide easily from one surface to the other. ("Log-rolling" refers to the typical process of getting a sheet or the like under an immobile patient without totally lifting the patient out of bed. The patient is first rolled to one side, away from the sheet, and the sheet is then pushed-in and bunched halfway under the patient. The patient is then rolled back over the bunched-up sheet to the other side, so that the bunched-up sheet can then be pulled the rest of the way under the patient.) Patient transfer devices using the inflatable plenum approach are thought to be commercially available under the "AIR PAL" designation from American Industrial Research, Inc., of Newark, Del. The following U.S. patents represent several attempts in this direction: U.S. Pat. No. 4,528,704 (Jul. 16, 1985 to Wegener et al.), U.S. Pat. No. 4,627,426 (Dec. 9, 1986 to Wegener et al), U.S. Pat. No. 4,686,719 (Aug. 18, 1987 to Johnson et al.), and U.S. Pat. No. 5,067,189 (Nov. 26, 1991 to Weedling et al.).

Others have tried to reduce the effort required in patient transfer by using thin, rigid or semi-rigid boards (sometimes referred to as "patient shifters") that can be slid beneath the patient to make it easier to either lift or slide the patient from one surface to another.

Other well-known attempts to ease patient transfer involve patient rollers, which had rollers on a thin frame mounted within a plasticized cloth covering to facilitate insertion of the cloth beneath the patient. Once the plasticized cloth was all the way under the patient, the entire assembly could then be lifted or pulled to facilitate transfer. Mobilizer Medical Products of Mount Vernon, N.Y., and presumably others, have produced powered versions of such patient rollers. With the roller linked to a powered base, the fabric is powered around the rollers so that it crawls under the patient. The base then uses hydraulics or the like to lift and pull the patient and the roller assembly off of the underlying patient support surface. The patient can then be moved to a new surface and the transfer fabric is rolled out from beneath the patient. Although effective, such powered devices are bulky and expensive.

SUMMARY OF THE INVENTION

The basic objective of Applicant's present invention is to address the problems and obstacles of the prior art in facilitating patient transfer.

Within this general objective, it is Applicant's objective to provide a simple, low-cost device and related methods for facilitating patient transfer and reducing the risk of injury to patients and caregivers. It is yet another objective to provide a patient transfer device that is both easy to package and easy to use. Among the many secondary objectives, it is also an objective to produce an effective patient transfer device that is attractive in appearance and comfortable to the hand of caregivers.

Although there may be challenges in balancing Applicant's various objectives, it will be understood by those of skill in the art that certain aspects of the present invention may capitalize on the object of low-cost manufacture at the sacrifice of patient comfort or utility. Vice versa, other embodiments may capitalize on the secondary object of durability while partially sacrificing the low-cost objective.

Applicant addresses these and other objects by providing an overlapping or continuous flexible sheet as a patient conveyor. The sheet can be very thin and is ideally fabricated such that there is a low coefficient of friction between surfaces. Inert micro-bubbles or other forms of lubricant may also be applied between the opposing interior surfaces.

Preferably, the conveyor of the present invention includes a continuous loop of thin polyethylene sheeting, such as is commonly available for forming plastic bags.

Many other objects, features and advantages will be apparent to those of ordinary skill in the art from the foregoing and following discussions and descriptions taken in conjunction with the accompanying drawings, particularly when considered in light of the claimed subject matter.

DETAILED DESCRIPTION OF PREFERRED EMBODIMENTS

The drawings briefly described above constitute part of this specification. It should be understood that they include embodiments of the present invention and illustrate various objects and features thereof.

Figure 1:
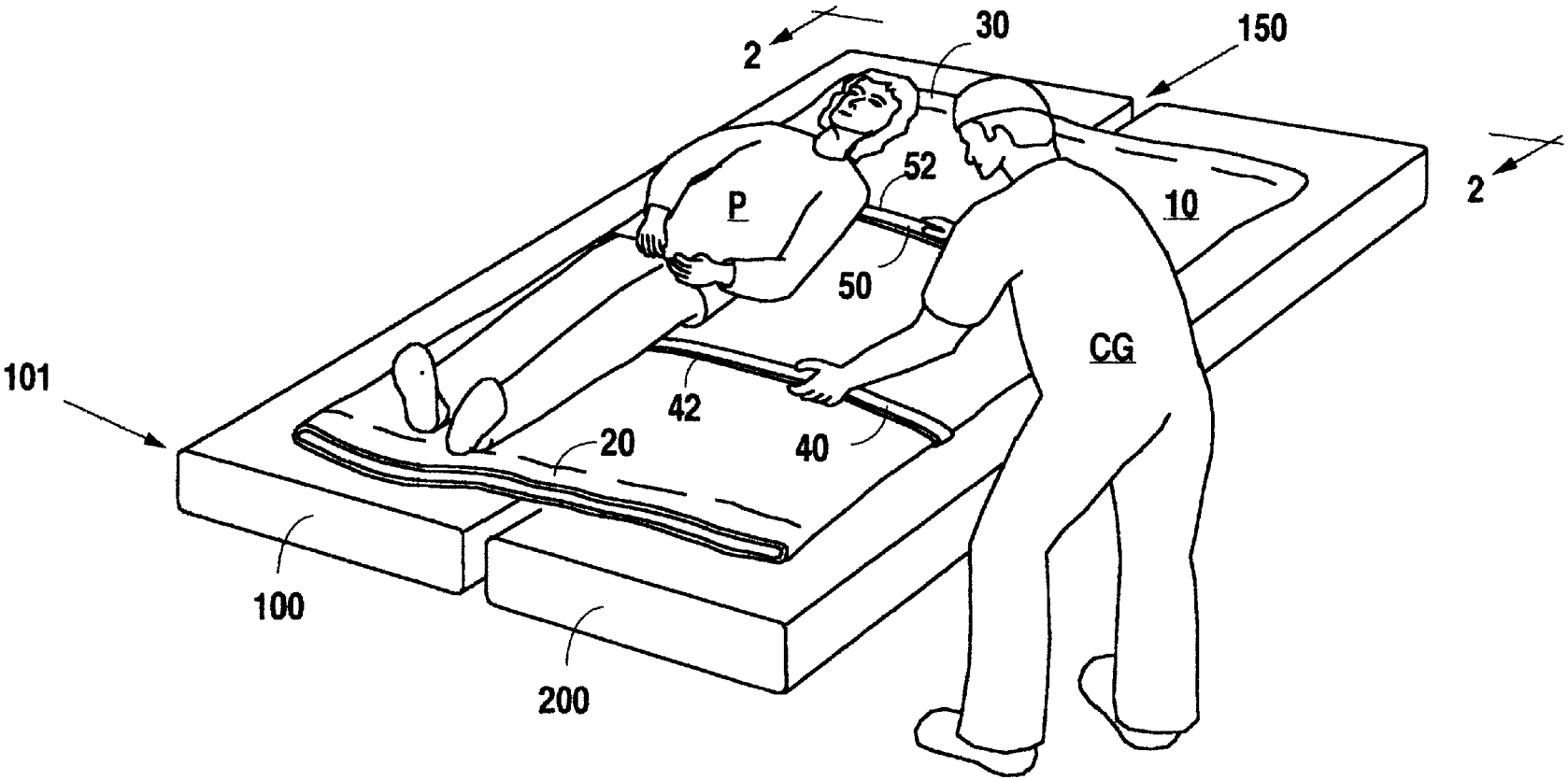
FIG. 1 shows a bird's eye perspective view of patient conveyor 10 operatively employed for transferring patient P from patient support surface 100 to patient support surface 200, under the influence of caregiver CG.

With reference to FIG. 1, a first embodiment of the present invention is illustrated as patient conveyor 10. Patient conveyor 10 is fabricated in a form that is simple, low-cost and easy to use for transferring a patient P from a first support 100 to a second support 200. FIG. 1 depicts the use of the conveyor 10 by caregiver CG and illustrates the typical transfer wherein the support surfaces 100 and 200 are mattress-like support surfaces that can be positioned in side-by-side relationship with a minimal gap 150 therebetween. It will be understood that mattress-like support surfaces are simply illustrative and that conveyor 10 is also readily usable for transfer between a wide variety of other types of patient support surfaces, such as gurneys, tables, stretchers, chairs, and many others.

Although not shown, if the gap 150 between the surfaces 100 and 200 in any particular application is so large that patient P might fall to the floor through gap 150, a crash-board (not shown) may be used in a conventional manner to help span gap 150. Such "crash boards" are well known in the hospital environment and are commonly used to span such gaps between surfaces for purposes of enabling transfer over such a gap. It will also be understood that adaptations and modifications may be made to conveyor 10 for other patient moving applications, such as to transfer a seated patient from one chair to another or to transfer the patient P lengthwise over the foot end 101 of surface 100.

Figure 2A:
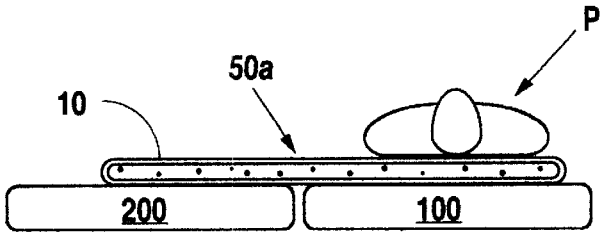
FIGS. 2A and 2B show progressive views of the process of transferring patient P from above surface 100 to above surface 200 using patient conveyor 10 of the present invention.
Figure 2B:
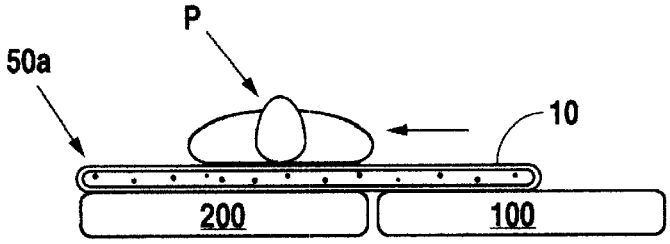

As illustrated in FIG. 1, and as is further represented in FIGS. 2A and 2B, patient conveyor 10 can be used by caregiver CG to ease the process of transferring patient P from surface 100 to surface 200. Conveyor 10 provides convenient handles 40 and 50 to be gripped by caregiver CG in pulling patient P from surface 100 to surface 200. As will be evident from further descriptions herein, conveyor 10 has the general form of a continuous belt on which patient P is readily conveyed when pulled (or pushed) by caregiver CG. For instance, when caregiver CG grips handle 50 at a point 50*a* thereon (as designated in FIG. 2A), and caregiver CG then pulls point 50A from the location depicted in FIG. 2A to the location depicted in FIG. 2B, patient P moves from above patient support 100 to above patient support 200. The process is repeated until patient P is fully positioned above support 200. Once such a patient transfer is complete, conveyor may then be removed from beneath patient P by caregiver CG log-rolling (or other techniques as may be desired).

Figure 3:
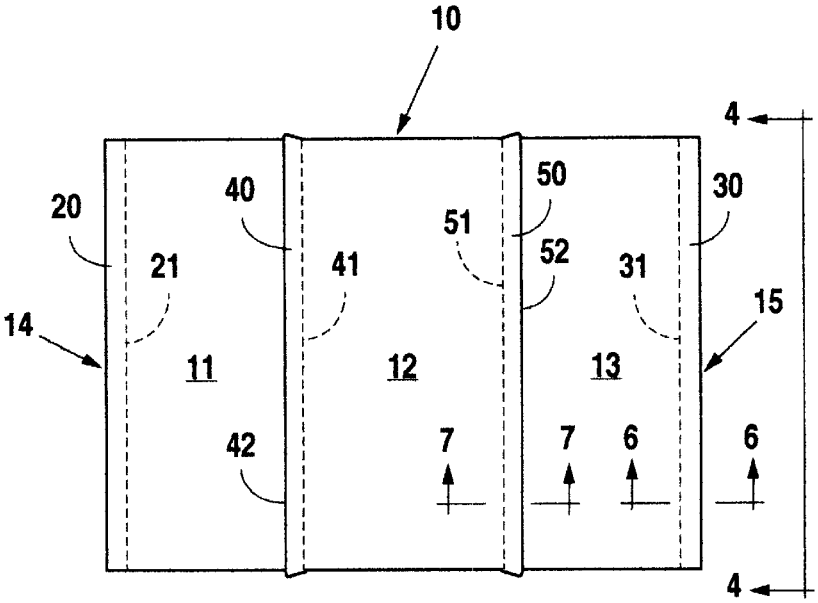
FIG. 3 shows a top view of patient conveyor 10 in its flattened operative form.
Figure 4:
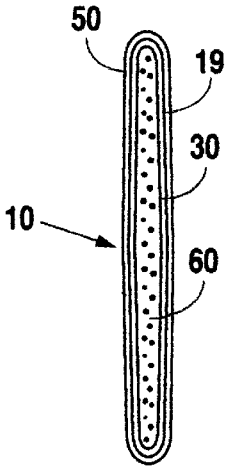
FIG. 4 shows an end-on view of patient conveyor 10, as viewed on plane 4—4 depicted in FIG. 3, with the thickness of conveyor 10 shown in exaggerated dimensions.

Referring now to FIGS. 3 and 4, further details of patient conveyor 10 can be appreciated. For reference, the left-to-right dimension visible in FIG. 3 is referred to as the length (or longitudinal dimension) of conveyor 10, and the top-to-bottom dimension visible in FIG. 3 is referred to as the width (or transverse dimension) of conveyor 10. FIG. 3 shows a top view of patient conveyor 10, and FIG. 4 shows an orthogonal, end-on view of conveyor 10, as viewed from head end 15 on plane 4—4 of FIG. 3. The view of FIG. 4 is very similar to that of FIGS. 2A and 2B, except that patient P and the underlying patient supports 100 and 200 are not shown in FIG. 4, and slightly more structural detail of conveyor 10 is depicted in FIG. 4. It should also be noted that, for purposes of illustration, the thickness of conveyor 10 (i.e., the left-to-right dimension in FIG. 4) is greatly exaggerated in each of FIGS. 2A, 2B and 4.

Several features of conveyor 10 are prominent in the view of FIG. 3, including margins 20 and 30 and handles 40 and 50. Margin 20 is formed at the foot end 14 of conveyor 10, and margin 30 is formed at the head end 15 of conveyor 10. Each of such longitudinal ends 14 and 15 of conveyor 10 includes a cut edge of the plastic material from which conveyor 10 is formed. For example, head end 15 includes cut edge 15; which is doubled-over to form margin 30 for added strength and durability at end 15. As evident in FIG. 3, the structure of conveyor 10 appears segmented into three portions 11–13 by belt-like handles 40 and 50. The structure of margin 40 is an identical mirror-image of that of margin 30, and the structure of handle 40 is likewise an identical mirror-image of that of handle 50; hence, detailed description of margin 30 and handle 50 will be understood to similarly describe margin 20 and handle 40, respectively.

Figure 5:
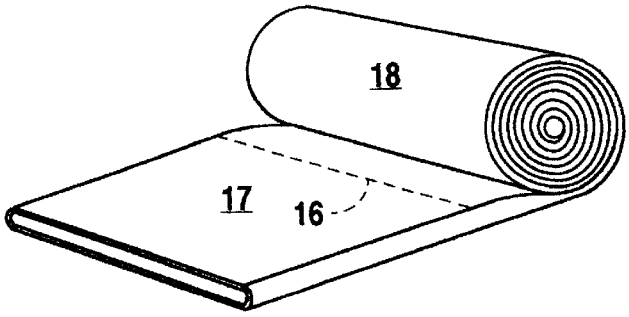
FIG. 5 shows a perspective view of a bulk roll 18 of tubing material such as used in fabrication of patient conveyor 10.

The construction of conveyor 10 can perhaps best be understood with reference to the manner in which a presently preferred embodiment (a prototype) of conveyor 10 has been made. Such embodiment of conveyor 10 is formed of polyethylene materials commercially available in strong, thin-walled, tube-like form. Although tube-like in form, bulk quantities of such material are available in rolls wherein the tube-like shape is flattened. One such roll, roll 18, is illustrated in FIG. 5. The preferred embodiment is formed from a roll 18 of sixty inch wide flattened polyethylene tubing, as is commercially available as packaging material for making plastic bags and the like. More particularly, the prototype is formed of a 2.5 mil nominal thickness metallocene catalyst polyurethane. Resin Dow PL1880 [made by Rexam Flexible Package of Lakefill, Minn. under the designation "Starflex L880-WP"]. Such material and other similar materials are fairly affordable such that conveyor 10 may be fabricated in a low-cost form, such as might be suitable as a disposable product.

To fabricate conveyor 10, an appropriate length of tubing stock is rolled from bulk roll 18 and is cut at dashed line 16 shown in FIG. 5. A particular preferred embodiment of conveyor 10 has been formed by making cut 16 such that the cut tubing portion 17 is 106 inches long. The width of such tubing 17 in the preferred embodiment is sixty inches and does not change significantly during fabrication. The length, on the other hand, changes by about eighteen inches in the process of making the other modifications to conveyor 10, as each of the features 20, 30 40 and 50 spans about three inches of the length of conveyor 10. Although specific dimensions of a preferred embodiment are detailed herein, it must be understood that dimensions will vary depending on preference, the dictates of the particular application, the inclusion or exclusion of various features, and any number of other factors. It is noted for instance that twenty-inch handles might still be suitable, as might handles which are integral with the longitudinal ends 14 and 15.

Figure 6:
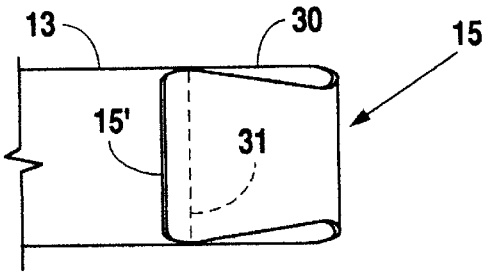
FIG. 6 shows a partial, cross-sectional detail view of the head end 15 of patient conveyor 10, as viewed along sectional plane 6—6 of FIG. 3.

With reference to FIG. 6, margin 30 is shown in detail, with the cut edge 15' of head end 15 folded inwardly to provide the doubled-over edge 30. In the preferred embodiment, the cut edge 15' is folded inwardly and heat welded in place along weld 31. In this way, the cut edge 15' is less likely to come in contact with a patient P being transferred on conveyor 10. As mentioned, margin 20 of the opposite end 14 is formed in an identical mirror-like fashion, albeit at the opposite end of conveyor 10.

Each of welds 21, 31, 41 and 51 may be formed with a series of successive applications of a linear bar welder around the circumference of conveyor 10.

Figure 6A:
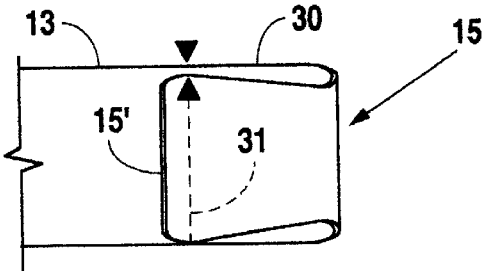
FIG. 6A shows the same view as FIG. 6, except that linear weld symbols are depicted in FIG. 6A to help illustrate the manner and location of applying weld 31 to end 15.

FIG. 6 shows a partial, cross-sectional detail view of the head end 15 of patient conveyor 10, as viewed along sectional plane 6—6 of FIG. 3; FIG. 6A shows the same view as FIG. 6, except that linear weld symbols are depicted in FIG. 6A to illustrate the manner and location of applying weld 31 to end 15.

Figure 7:
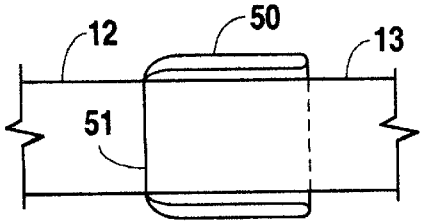
FIG. 7 shows a partial, cross-sectional detail view of circumferencial handle 50 of patient conveyor 10, as viewed along sectional plane 7—7 of FIG. 3.
Figure 7A:
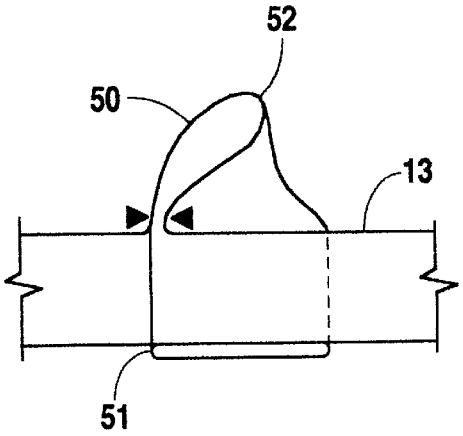
FIG. 7A shows the same view as FIG. 7, except that the distal edge 52 of the upper course of handle 50 is shown lifted from portion 13 to reveal more of its structure, and linear weld symbols are depicted in FIG. 7A to help illustrate the manner and location of applying weld 51 to form handle 50.

FIG. 7 shows a partial, cross-sectional detail view of circumferencial handle 50 of patient conveyor 10, as viewed along sectional plane 7—7 of FIG. 3; FIG. 7A shows the same view as FIG. 7, except that linear weld symbols are depicted in FIG. 7A to illustrate the manner and location of applying weld 51 to form handle 50.

With reference to FIG. 7, handles 40 and 50 of conveyor 10 are preferably formed by circumferential folds in the fabric of conveyor 10. The folds which form handles 40 and 50 are preferably folded away from the central portion 12 of conveyor 10, such that a caregiver CG standing adjacent the central portion 12 can more readily grasp around the outward facing folds 42 and 52 of handles 40 and 50.

Once circumferential welds 21, 31, 41 and 51 have been made (thereby completing the basic structural modifications to the polyethylene stock 17, a small quantity of micro balloons are distributed within the interior of conveyor 10 to function as tiny ball bearings which ease translation of one surface relative another. In prototypes, a small quantity of borasilicate glass micro-bubbles (0.37 g/cc nominal density, have been used such as are available from G-3/Archway sales of Aurora, Colo. [made by 3M under the "Scotchlite K37" designation]. The quantity of micro balloons in the preferred embodiment is relatively small, on the order of about 1 to 5 tablespoons. Glass microspheres commonly utilized in fluidized bead beds might also be employed for the same purpose.

In alternate embodiments, other materials may be substituted within the interior sleeve 19 of conveyor 10 or similar conveyors. For instance, other solid lubricants are known, and there are many liquid lubricants that may be suitable as well. Preferably, such a lubricant should be chosen from lubricants which are nontoxic and hypoallergenic. The Borasilicate glass bubbles of the preferred embodiment have been found to be suitable for the presently preferred embodiment of conveyor 10 as they are both chemically inert, nontoxic and hypoallergenic.

Other fabrics may also be suitable for alternative embodiments, although the polyethylene plastic has been found to render an affordable construction. Such polyethylene material has also been found to be very effective for accomplishing the low friction objects of the invention, due largely to its smooth finish. Such smooth finish appears ideal for minimizing friction between top and bottom layers of conveyor 10. Alternative embodiments may substitute the preferred polyethylene material with fabrics commonly referred to as "nylon rip stock" or "filter sheet" material (a/k/a "sail cloth"). Both rip stock and sail cloth are thin, light-weight, woven fabrics. Still other fabrics may be suitable, such as Teflon-coated nylon fabrics commercially available as "GORE-Tex" fabric, although such materials are more costly and are not thought to perform as well as polyethylene.

The resulting construction is likely to be single patient use construction that would be discarded after each use or after each patient, although it may be that suitable infection control procedures can be developed for reprocessing conveyor 10 for multiple patient use.

Still other alternative embodiments may be fabricated from multi-layered laminate compositions such as compositions with cotton-like feel on the outer surface of conveyor 10. Such cotton-like feel may allow for caregivers or patients to be more receptive of conveyor 10 and may allow for additional comfort for the same. In still other alternative embodiments, strips of cotton, terrycloth or polyurethane foam strips may be applied in tape-like adhesive fashion in each of the open areas of portions 11–13, or it may be desirable to simply place such tape-like applications on handles 40 and 50 for extra grip.

The finished length of conveyor 10 in the preferred embodiment is approximately 60 to 90 inches such that its length approximates or exceeds the height of a human patient. Preferably, although at some additional costs, the length of conveyor 10 is fabricated to be longer than most patients such that the entire length of the patient may be situated on conveyor 10 for patient transfer. Although dimensions may vary. A particular prototype of conveyor 10 has been fabricated such that each of margins 20 and 30 and handles 40 and 50 are 3 inches wide as viewed from above, as in FIG. 3. Portions 11–13 are each approximately 26 inches wide in the prototype, and are generally of the same dimensions of each other, although it may be desirable to have the central portion 12 wider than the distal portions 11–13. Distal portions 11–13 may be 26 inches wide, whereas central portion 12 might be 30 inches wide. It will be apparent to those of skill in the art that many other dimensions, and even elimination of one or more of portions 11–13, will be suitable for certain purposes of the present invention.

One possible alternative embodiment would use fabric formed in an open-ended loop rather than a continuous loop. Such, embodiment could be formed as a sheet folded over on itself, with microballoons (or lubricants) in between the overlapping folds. Other embodiments might be possible as multi-layered conveyor sheets stacked atop each other.

While the description given herein reflects the best mode known to the inventor, those who are reasonably skilled in the art will quickly recognize that many omissions, additions, substitutions, modifications and alternate embodiments may be made of the teachings herein. Recognizing that those of reasonable skill in the art will easily see such alternate embodiments, they have in most cases not been described herein in order to preserve clarity.

What is claimed is:

1. A patient transfer device for facilitating patient transfer from a first patient support to a second patient support, comprising:

a substrate formed in a loop having an upper and a lower course;

said substrate being positionable under a patient on a first patient support, in a position between the first patient support and the patient;

a plurality of grip handles formed on the exterior of said loop by circumferential folds of said substrate, such that said handles may be trapped at various locations around the circumference of said loop;

wherein said substrate is flexible such that, when the substrate is operatively positioned between the first patient support and the patient, portions of said substrate which are in the upper course tend to bear against portions of said substrate which are in the lower course; and wherein said portions of the substrate are translatable relative to each other such that the upper course of said sheet is translatable relative to the lower course of said sheet when a lateral force is exerted on the upper course of said loop.

2. The patient transfer device of claim 1, wherein said loop is continuous.

3. The patient transfer device of claim 1, further comprising a lubricant between the upper and lower courses of said loop.

4. The patient transfer device of claim 3, wherein said lubricant is a solid lubricant.

5. The patient transfer device of claim 3, wherein said lubricant is a liquid lubricant.

6. The patient transfer device of claim 3, wherein said lubricant comprises between 1 and 5 tablespoons by volume.

7. The patient transfer device of claim 3, wherein said lubricant comprises micro-balloons.

8. The patient transfer device of claim 3, wherein said lubricant comprises borasilicate glass micro-bubbles.

9. The patient transfer device of claim 8, wherein said micro-bubbles have a density of about 0.37 grams per cubic centimeter.

10. The patient transfer device of claim 1, wherein said substrate comprises a polurethane material.

11. The patient transfer device of claim 10, wherein said substrate is formed in said loop in a manner such that the polyurethane material is exposed to the interior of said loop.

12. The patient transfer device of claim 11, wherein said substrate is formed in said loop in a manner such that the exterior of said loop comprises an absorbent material.

13. The patient transfer device of claim 1, further comprising reinforced margins formed around the circumference of said loop.

14. The patient transfer device of claim 1, wherein the circumferential folds of said grip handles are folded away from an interior region defined between the upper course and the lower course.

15. The patient transfer device of claim 1, wherein the circumferential folds of the grip handles are formed with welds.

16. The patient transfer device of claim 1, wherein the circumferential folds segment the patient transfer device into three portions.

17. The patient transfer device of claim 1, wherein the substrate comprises 60-inch wide flattened polyethylene tubing.

* * * * *